United States Patent [19]

Ikeda et al.

[11] Patent Number: 4,479,138

[45] Date of Patent: Oct. 23, 1984

[54] HEAT-SENSITIVE RECORDING MATERIALS

[75] Inventors: Kensuke Ikeda; Akira Igarashi, both of Shizuoka, Japan

[73] Assignee: Fuji Photo Film Co., Ltd., Kanagawa, Japan

[21] Appl. No.: 428,521

[22] Filed: Sep. 29, 1982

[30] Foreign Application Priority Data

Oct. 6, 1981 [JP] Japan ..... 56-159264

[51] Int. Cl.[3] ..... B41M 5/18

[52] U.S. Cl. ..... 346/207; 346/208; 346/209; 346/213

[58] Field of Search ..... 282/27.5; 427/150, 151; 428/320.8, 411, 488, 537, 913, 914

[56] References Cited

U.S. PATENT DOCUMENTS 4,093,278 6/1978 Sears ..... 282/27.5

FOREIGN PATENT DOCUMENTS 0138983 8/1982 Japan ..... 346/208
0178791 11/1982 Japan ..... 346/204
0203589 12/1982 Japan ..... 346/200
0203592 12/1982 Japan ..... 346/208

*Primary Examiner*—Bruce H. Hess
*Attorney, Agent, or Firm*—Sughrue, Mion, Zinn, Macpeak & Seas

[57] ABSTRACT

A heat-sensitive recording material is disclosed. The material is comprised of an electron donating dye, electron accepting compound and a sensitivity improving agent thereon. The sensitivity improving agent is a compound represented by the general formula (I)

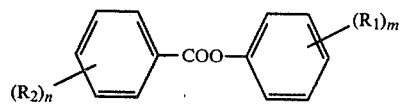

(I)

wherein $R_1$ and $R_2$ independently represent an alkyl group, an aralkyl group, an aryl group, an alkoxy group having 12 or less carbon atoms or a halogen atom, and m and n independently represent 0 or an integer of 5 or less. By including the sensitivity improving agent, it is possible to obtain a heat-sensitive recording material which produces an image of high color density.

7 Claims, No Drawings

HEAT-SENSITIVE RECORDING MATERIALS

FIELD OF THE INVENTION

The present invention relates to heat-sensitive recording materials and, particularly, to heat-sensitive recording materials having high speed thermal response.

BACKGROUND OF THE INVENTION

U.S. Pat. Nos. 2,663,654 and 2,967,785, corresponding to Japanese Patent Publication Nos. 14039/70 and 4160/68 respectively, disclose that it is possible to obtain color images by reacting an electron donating colorless dye (referred to as a color former, hereinafter) with an electron accepting compound (referred to as a color developer, hereinafter) by heating. Such heat-sensitive recording materials have recently been used as recording paper for facsimile.

Recently, the speed required of a facsimile recording apparatus and printing with heat-sensitive elements has increased. Accordingly, it is necessary for the heat-sensitive recording materials to respond within a shorter time. In the past, recording sensitivity has been generally increased in order to increase the speed of response.

The recording sensitivity indicates the relationship between the heat energy applied to the heat-sensitive recording layer and the image density obtained. A heat-sensitive system which obtains deep colors by applying a small amount of energy is called a highly sensitive system, and a heat-sensitive system which requires higher energy in order to obtain sufficient density is called a low sensitivity system.

Methods of increasing recording sensitivity which comprise adding various substances to the heat-sensitive color forming layer in the heat-sensitive recording materials have been proposed (Japanese patent application (OPI) Nos. 19231/73, 62189/81 and 48751/78 corresponding to U.S. Pat. No. 4,236,732). However, although the use of such substances increases recording sensitivity to some extent, it is still not possible to obtain heat-sensitive recording materials sufficiently sensitive to satisfy present market requirements.

SUMMARY OF THE INVENTION

In the light of such circumstances, the present inventors have carried out the earnest studies in order to obtain heat-sensitive recording materials having a higher sensitivity. As a result of these studies, the present inventors have found that the recording sensitivity of heat-sensitive recording materials having a heat-sensitive color forming layer containing a color former and a color developer can be greatly increased by the addition of a compound represented by the following general formula (I) to the heat-sensitive color forming layer.

The heat-sensitive recording materials of the present invention comprise a colorless or light-colored donative dye, an electron accepting compound which forms colors by reacting with said electron donating dye, and a compound represented by the following general formula (I):

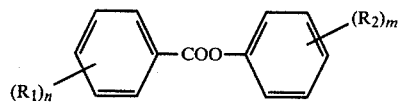

(I)

wherein $R_1$ and $R_2$ each represents an alkyl group, an aralkyl group, an aryl group, an alkoxy group having 12 or less carbon atoms, or a halogen atom, $R_1$ and $R_2$ may be identical or different each other, and m and n each represents 0 or an integer of 5 or less. The alkyl group and the alkoxy group have preferably 3 to 9 carbon atoms and the aryl group and the aralkyl group have preferably 6 carbon atoms and 7 to 9 carbons atoms, respectively.

DETAILED DESCRIPTION OF THE INVENTION

The color formers used in the present invention are those called leuco dyes, many of which are used as colorless dyes for heat-sensitive recording paper. They color by reacting with color developers. Examples of the color formers include aminophthalides such as triarylmethane compounds, diphenylmethane compounds, xanthene compounds, thiazine compounds and spiropyran compounds.

Specific examples of triarylmethane compounds include 3,3-bis-(p-dimethylaminophenyl)-6-dimethylaminophthalide (namely, Crystal Violet lactone), 3,3-bis-(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis-(1,2-dimethylindol-3-yl)-5-dimethylaminophthalide, 3,3-bis-(1,2-dimethylindol -3-yl)-6-dimethylaminophthalide, 3,3-bis-(9-ethylcarbazol-3-yl)-5-dimethylaminophthalide, 3,3-bis-(2-phenylindol-3-yl)-5-dimethylaminophthalide and 3-p-dimethylaminophenyl-3-(1-methylpyrrol-2-yl)-6-dimethylaminophthalide.

Specific examples of diphenylmethane compounds include 4,4'-bis-dimethylaminobenzhydrin benzyl ether, N-halophenyl leuco Auramine and N-2,4,5-trichlorophenyl leuco Auramine.

Specific examples of xanthene compounds include Rhodamine B anilino lactam, Rhodamine (p-nitroanilino)lactam, Rhodamine B (p-chloroanilino)lactam, 7-dimethylamino-2-methoxyfluoran, 7-diethylamino-2-methoxyfluoran, 7-diethylamino-3-methoxyfluoran, 7-diethylamino-3chlorofluoran, 7-diethylamino-3-chloro-2-methylfluoran, 7-diethylamino-2,3-dimethylfluoran, 7-diethylamino-(3-acetylmethylamino)fluoran, 7-diethylamino-(3-methylamino)-fluoran, 3,7- diethylaminofluoran, 7-diethylamino-3-(dibenzylamino)fluoran, 7-diethylamino-3-(methylbenzylamino)fluoran, 7-diethylamino-3-(chloroethylmethylamino)fluoran and 7-diethylamino-3-(diethylamino)fluoran.

Specific examples of thiazine compounds include benzoyl leuco Methylene Blue and p-nitrobenzyl leuco Methylene Blue.

Specific examples of spiro compounds include 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)spiropyran and 3-propyl-spiro-dibenzopyran.

These compounds may be used alone or as a mixture.

Examples of the color developers include phenol compounds, organic acids or metal salts thereof, oxybenzoic acid esters and clays.

Specific examples of phenol compounds include 4,4-isopropylidene-diphenol (bisphenol A), p-tert-butylphenol, 2,4-dinitrophenol, 3,4-dichlorophenol, 4,4'-methylene-bis (2,6-di-tert-butylphenol), p-phenylphenol, 1,1-bis-(4-hydroxyphenyl)cyclohexane, 1,1-bis-(4-hydroxyphenyl)-2-ethylhexane, 2,2-bis-(4-hydroxyphenyl)butane, 2,2'-methylene-bis-(4-tert-butylphenol), 2,2'-methylene-bis-(α-phenyl-p-cresol)thiodiphenol, 4,4'-thio-bis-(6-tert-butyl-m-cresol) and sulfonyldiphenol as well as p-tert-butylphenol-formaldehyde condensate and p-phenylphenol-formaldehyde condensate.

Specific examples of organic acids and metal salts thereof include phthalic acid, phthalic acid anhydride, maleic acid, benzoic acid, gallic acid, o-toluic acid, p-toluic acid, salicylic acid, 3-tert-butylsalicylic acid, 3,5-di-tert-butylsalicylic acid, 5-α-methylbenzylsalicylic acid, 3,5-(α-methylbenzyl)salicylic acid, 3-tert-octylsalicylic acid and zinc salts, lead salts, aluminium salts, magnesium salts and nickel salts thereof. Particularly, salicylic acid derivatives and zinc or aluminum salts thereof are excellent in the viewpoint of developability, fastness of color images and preservability of recorded sheets.

Specific examples of oxybenzoic acid esters include ethyl p-oxybenzoate, butyl p-oxybenzoate, heptyl p-oxybenzoate and benzyl p-oxybenzoate.

Specific examples of clays include activated clay, acid clay, attapulgite and activated alumina.

Specific examples of the sensitivty improving agent used in the present invention include phenyl benzoate, phenyl 2-chlorobenzoate, phenyl 3-methylbenozate, phenyl 4-methylbenzoate, phenyl 4-octylbenzoate, 2'-chlorophenyl benzoate, 4'-chlorophenyl benzoate, 3'-methylphenyl benzoate, 4'-methylphenyl benzoate, 3',4'-dimethylphenyl benzoate, 4'-octylpheny benzoate, 3'-methylphenyl 4-methylbenzoate and 4'-phenylphenyl benzoate.

The sensitivity improving agent is used by dispersing it in a dispersion medium by means of a ball mill so as to have a particle size of 10 μm or less. Alternatively, it may be added to the dispersion medium simultaneously while dispersing the color former and/or the color developer in the dispersion medium by a ball mill or similar device.

The color former, the color developer and the sensitivity improving agent of the present invention are ground and dispersed in a dispersion medium so as to have a particle size of 10 μm or less, the particle size being a volume average size and being calculated according to the following formula:

$$\text{Volume Average Size} = 3\sqrt{\frac{6}{\pi}\cdot\frac{\text{Total volume of whole particles}}{\text{Number of whole particles}}}$$

The dispersion medium is generally comprised of an aqueous solution of water soluble high polymers dispersed in water in a concentration of 1 to 10% by weight. Dispersing is carried out by a means such as a ball mill, sand mill, attriter or colloid mill.

The preferred ratio of the color former to the color developer is in the range of 1:10 to 1:1 by weight, more preferably in the range of 1:5 to 2:5 by weight. The sensitivity improving agent of the present invention is added in an amount of 20% to 300%, preferably 50% to 150% by weight, based on the color developer. If the amount of the sensitivity improving agent is less than 20%, improvement of the sensitivity which is the object of the present invention is not sufficiently attained. Further, if the agent is added in an amount of more than 300%, there is some deterioration of sensitivity because the heat capacity of the system increases excessively.

Other additives may be combined with the heat-sensitive coating liquid of the present invention in order to satisfy various requirements.

For example, it is possible to add oil absorbing materials such as inorganic pigments, etc. dispersed in a binder in order to prevent contamination of the head or to promote a releasing property from the head. Further, materials such as aliphatic acids or metal soaps may be added in order to improve the releasing property with respect to the head. Accordingly, the heat-sensitive recording materials of the present invention are generally composed of pigments, waxes and additives in addition to the color former and the color developer which directly contribute to color formation. All of these materials may be combined together in various ways applied to a base.

Examples of pigments include kaolin, calcined kaolin, talc, agalmatolite, diatom earth, calcium carbonate, aluminium hydroxide, magnesium hydroxide, magnesium carbonate, titanium oxide, barium carbonate, urea-formaline filler and cellulose filler.

Examples of waxes include paraffin wax, carnauba wax, microcrystalline wax, polyethylene wax and higher aliphatic acid esters.

Examples of metal soaps include polyvalent metal salts of higher aliphatic acids, such as zinc stearate, aluminium stearate, calcium stearate or zinc oleate.

Color formers, color developers, pigments, waxes and other additives are coated after being dispersed in a binder. Useful water soluble materials are generally used, examples of which include polyvinyl alcohol, hydroxyethyl cellulose, hydroxypropyl cellulose, ethylene-maleic acid anhydride copolymer, styrene-maleic acid anhydride copolymer, isobutylene-maleic acid anhydride copolymer, polyacrylic acid, polyacrylamide, starch derivatives, casein and gelatine, etc. Further, in order to give water resistance to the binder, it is possible to add waterproofing agents (gelling agents or cross-linking agents) or emulsions of hydrophobic polymer such as a styrene-butadiene rubber latex or an acrylic resin emulsions, etc.

In the following, examples are described, but the present invention is not limited to them.

EXAMPLE 1

(Dispersion A)

20 g of 3-diethylamino-6-chloro-7-(β-ethoxyethylamino)fluoran (color former) was added to a 5% by weight aqueous solution of polyvinyl alcohol (degree of polymerization: 500; saponification value: 99%) and processed by a ball mill for 10 hours to disperse therein.

(Dispersion B)

100 g of 2,2-bis-(p-hydroxyphenyl)propane and 100 g of phenyl benzoate were added to 500 g of a 5% by weight aqueous solution of polyvinyl alcohol and processed by a ball mill for 24 hours to disperse therein.

The dispersion A was blended with the dispersion B. To the mixture, 250 g of calcined kaolin and 400 g of a 10% by weight aqueous solution of polyvinyl alcohol were added, and the resulting mixture was processed again for 5 hours in the ball mill.

The resulting coating solution was applied to a base paper having a weight of 50 g/m$^2$ by means of a wire bar so as to result in a dried coating amount of 6 g/m$^2$, thus forming the heat-sensitive recording material of the present invention.

EXAMPLE 2

(Dispersion C)

20 g of 3-cyclohexylmethylamino-6-methyl-7-anilinofluoran (color developer) was added to a 5% by weight aqueous solution of polyvinyl alcohol (degree of polymerization: 500; saponification value: 99%) and processed by a ball mill for 10 hours to disperse therein.

(Dispersion D)

100 g of 1,1-bis-(p-hydroxyphenyl)-2-butyloctane and 100 g of phenyl 4-methylbenzoate were added to 500 g of a 5% by weight aqueous solution of polyvinyl alcohol, and processed for 24 hours by a ball mill to disperse therein.

The dispersion C was blended with the dispersion D. To the mixture, 250 g of calcined kaolin and 400 g of a 10% by weight aqueous solution of polyvinyl alcohol were added, and the resulting mixture was processed again for 5 hours in a ball mill.

The resulting coating liquid was applied to a base paper having a weight of 50 g/m$^2$ by means of a wire bar so as to result in a dried coating amount of 6 g/m$^2$, thus forming the heat-sensitive recording material of the present invention.

COMPARATIVE EXAMPLE 1

A comparative heat-sensitive recording material was obtained by the same procedure as in Example 1, except that phenyl benzoate was not used in the dispersion B.

COMPARATIVE EXAMPLE 2

A comparative heat-sensitive recording material was obtained by the same procedure as in Example 1, except that stearic acid amide was used instead of phenyl benzoate in the dispersion B.

COMPARATIVE EXAMPLE 3

A comparative heat-sensitive recording material was obtained by the same procedure as in Example 2, except that phenyl 4-methylbenzoate was not used in the dispersion D.

The resulting heat-sensitive recording materials of the Examples and Comparative Examples were developed over their surfaces by varying the width of pulses and the applied voltage of the facsimile (EF-22R produced by Matsushita Denso Co.), namely by varying the applied energy. The relation between the color density and the applied energy (mJ/mm$^2$) is shown in Table 1. It is understood from the table that the sensitivity of the heat-sensitive recording materials of the present invention increases remarkably in, particularly, the low energy area, as compared with the prior heat-sensitive recording materials.

TABLE 1

| | Color Density (note) (mJ/mm$^2$) | | |
|---|---|---|---|
| | 25 | 33 | 40 |
| Example 1 | 0.43 | 0.84 | 1.03 |
| Example 2 | 0.45 | 0.85 | 1.07 |

TABLE 1-continued

| | Color Density (note) (mJ/mm$^2$) | | |
|---|---|---|---|
| | 25 | 33 | 40 |
| Comparative Example 1 | 0.09 | 0.17 | 0.33 |
| Comparative Example 2 | 0.18 | 0.40 | 0.68 |
| Comparative Example 3 | 0.10 | 0.21 | 0.41 |

(Note)
Color density was measured by means of a Macbeth RD-514 reflective densitometer using a visual filter.

While the invention has been described in detail and with reference to specific embodiment thereof, it will be apparent to one skilled in the art that various changes and modifications can be made therein without departing from the spirit and scope thereof.

What is claimed is:

1. A heat-sensitive recording material comprising:

a support sheet having provided thereon:

electron donating dye particles having a particle size of 10 μm or less prepared from a dispersion wherein the dye is dispersed in a dispersion medium;

electron accepting compound particles capable of forming a color upon reaction with the electron donating dye and having a particle size of 10 μm or less prepared from a dispersion wherein the electron accepting compound is dispersed in the dispersion medium;

particles of a compound represented by general formula (I) having a particle size of 10 μm or less and being present in an amount of 20% to 300% by weight based on the weight of the electron accepting compound prepared from a dispersion wherein the compound of general formula (I) is dispersed in the dispersion medium:

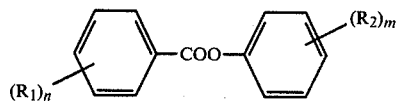

(I)

wherein $R_1$ and $R_2$ independently represent an alkyl group, an aralkyl group, an aryl group, an alkoxy group having 12 or less carbon atoms or a halogen atom, and m and n independently represent 0 or an integer of 5 or less.

2. A heat-sensitive recording material, as claimed in claim 1, wherein when $R_1$ and $R_2$ represent the alkyl group, the aralkyl group, the aryl group or the alkoxy group, those have 3 to 9, 7 to 9, 6 or 3 to 9 carbon atoms respectively.

3. A heat-sensitive recording material, as claimed in claim 1, wherein the electron donating dye is a colorless electron donating dye.

4. A heat-sensitive recording material, as claimed in claim 1, wherein the electron donating dye is a lightcolored electron donating dye.

5. A heat-sensitive recording material as claimed in claim 1, wherein the particles are contained within the dispersion in a concentration of 1 to 10%.

6. A heat-sensitive recording material as claimed in claim 5, wherein the compound of the general formula (I) is present in an amount of 50% to 150% by weight based on the weight of the electron accepting compound.

7. A heat-sensitive recording material as claimed in claim 1, wherein the electron donating dye and electron accepting compound are contained within a dispersion medium, the dispersion medium being an aqueous solution of water soluble high polymers.

* * * * *